US007644924B2

(12) United States Patent
Horowitz

(10) Patent No.: US 7,644,924 B2
(45) Date of Patent: Jan. 12, 2010

(54) THREE DIMENSIONAL SUDOKU CUBE PUZZLE AND METHOD

(76) Inventor: Jay Horowitz, P.O. Box 69, Sebring, OH (US) 44672

( * ) Notice: Subject to any disclaimer, the term of this patent is extended or adjusted under 35 U.S.C. 154(b) by 10 days.

(21) Appl. No.: 11/800,942

(22) Filed: May 8, 2007

(65) Prior Publication Data

US 2007/0267813 A1 Nov. 22, 2007

Related U.S. Application Data

(60) Provisional application No. 60/800,234, filed on May 13, 2006.

(51) Int. Cl.
*A63F 9/08* (2006.01)

(52) U.S. Cl. ..... 273/153 S

(58) Field of Classification Search ..... 273/153 R, 273/153 S

See application file for complete search history.

(56) References Cited

U.S. PATENT DOCUMENTS

| | | | | |
|---|---|---|---|---|
| 3,565,442 | A * | 2/1971 | Klein | 273/157 R |
| 4,378,116 | A | 3/1983 | Rubik | |
| 4,378,117 | A | 3/1983 | Rubik | |
| 4,410,179 | A | 10/1983 | Rubik | |
| 4,427,197 | A * | 1/1984 | Doose | 273/153 S |
| 4,437,667 | A * | 3/1984 | Miller | 273/153 S |
| 4,817,952 | A | 4/1989 | Biro et al. | |
| 5,184,822 | A | 2/1993 | Bognar et al. | |
| 6,422,560 | B1 * | 7/2002 | Harbaugh | 273/157 R |
| 6,626,431 | B2 * | 9/2003 | Possidento | 273/153 S |
| 7,100,917 | B2 * | 9/2006 | Wang | 273/153 S |

FOREIGN PATENT DOCUMENTS

| | | | |
|---|---|---|---|
| GB | 2426464 | A * | 11/2006 |
| NL | 1032337 | C2 * | 11/2007 |

* cited by examiner

*Primary Examiner*—Steven Wong
(74) *Attorney, Agent, or Firm*—David E Herron, II

(57) ABSTRACT

This application discloses a three dimensional puzzle bearing the shape of a cube. The application also discloses a method of integrating spatial logic using a three dimensional puzzle.

15 Claims, 6 Drawing Sheets

THREE DIMENSIONAL SUDOKU CUBE PUZZLE AND METHOD

SUMMARY OF THE INVENTION

The invention is a three dimensional puzzle bearing the shape of a cube; it is also a method of integrating spatial logic using a three dimensional puzzle.

THE INVENTIVE PUZZLE

The inventive puzzle forms the shape of a cube made from cubiform elements of substantially uniform size. These elements are joined together so that outer faces of the cubiform elements comprise respective surfaces the cube. Mutually perpendicular axes of rotation intersect at the center of the cube, and pass orthogonally through a center point of each face of the cube.

The puzzle will also include integrally formed cam elements that retain horizontal rows of cubiform elements into engagement with one another, yet allow relative movement of one of a selected row with respect to its adjacent row by imparting rotation to one of the axes. Analogously, integrally formed cam elements retain vertical columns of cubiform elements into engagement with one another, yet allow relative movement of one selected column with respect to an adjacent column. These integrally formed cam elements allow relative rotation of a selected row or column with respect to its adjacent row or column.

When the puzzle is in the solved condition, at least one surface bears each of the nine numbers with no duplicates. In another embodiment of the solved condition, more than one than one of the surfaces bears each of the numbers with no duplicates when in the solved condition. Even more difficult is the optional embodiment of the solved condition that requires each of the six cube surfaces to bear one of each of the single-digit natural numbers with no duplicates. While the preferred embodiment includes selecting single-digit natural numbers as indicia, any other type of unique indicia could be chosen. For example, the indicia may be fruit likenesses, raised or textured indicia (for visually impaired), cartoon characters, or the like.

In yet another embodiment, the puzzle includes a first surface that is horizontal and facing downward, and a first group of three horizontal rows having nine consecutive elements that traverse three contiguous surfaces of the puzzle. Each row is parallel to the first surface, and has an original edge coinciding with an edge orthogonal the first surface. In this embodiment, the solved condition requires that each horizontal row (or at least one row) have one of each number without duplicate.

The puzzle may also include a selected second group of three horizontal rows, each with nine consecutive elements that traverse three contiguous faces of the puzzle. Each row is parallel the first surface and shares its original edge with an edge orthogonal to the first surface. In this embodiment, the solved condition requires each of the second group of rows (or at least one of them) bears one of each number without duplicate.

In another embodiment, the puzzle will include a first group of three vertical selected columns, each with nine consecutive elements that traverse three contiguous surfaces and begin at an edge of the first surface and traverse the first surface. This option of the solved condition requires each vertical column (or at least one of them) of the first group to have no duplicate numbers.

Optionally, a player may select a second group of three selected columns, each column having nine consecutively adjacent elements and beginning at an edge of the first surface and traversing the first surface. In this embodiment, the solved condition requires that each column (or at least one of them) of the second group of columns consists of no duplicate numbers when the puzzle is in the solved condition. The first and second groups may coincide on the first surface.

In yet another embodiment of the puzzle, each face bears one of six distinct colored indicia. For example, the numbers may bear this color. In this embodiment, the solved condition requires one to manipulate the puzzle until at least one surface of the cube bears indicia of uniform color. Of course, a solved condition of the puzzle may also require one to manipulate it until two or more surfaces of the cube bear indicia of uniform color.

THE INVENTIVE METHOD

The invention is also a method of integrating logic that is ordinarily embodied in a two-dimensional Sudoku game into a three-dimensional puzzle. The inventive method includes the step of providing a cube of cubiform elements of substantially uniform size, the cubiform elements joined together so that outer faces of the cubiform elements comprise respective surfaces the cube. The method will also include the step of providing mutually perpendicular axes of rotation that intersect at the centroid of the cube. These axes pass orthogonally through respective center points of each surface of the cube.

Moreover, the method will also require one to integrally form cam elements that are configured to retain horizontal rows of cubiform elements into engagement with one another, yet allow relative movement of one of a selected row with respect to its adjacent row. Also, the method requires one to integrally form cam elements that retain vertical columns of cubiform elements into engagement with one another, yet allow relative movement of one selected column with respect to an adjacent column. The integrally formed cam elements allow relative rotation of a selected one of a row or column, the relative rotation being about one of the axes at one selected time.

The method will also include the step of placing one single-digit natural number on each outer face, and solving the puzzle so that at least one surface of the puzzle bears each of the nine single-digit natural numbers without duplicate. A more difficult solution method, of course, will require making more than one (or all) of the surfaces of the puzzle comprise only one of each single-digit number, without duplicate. The surfaces of the puzzle, which generally comprise a three-by-three square, are also known as Regions of the puzzle. Thus, a more difficult solution for the puzzle is to require all regions to comprise only one of each single digit number.

The method may also include the step of orienting the puzzle so that a first surface is horizontal and facing downward, and selecting a first group of three rows, each in the first group having nine consecutive elements that traverse three contiguous surfaces of the puzzle and an orientation parallel to the first surface. The beginning of each row will coincide with an edge orthogonal the first surface (or region). In this embodiment, the solved condition requires each of the first group of rows (or at least one of them) to have one of each number without duplicate.

The inventive method may also include the analogous step of selecting a second group of three rows such that each row has nine consecutive elements that traverse three contiguous faces of the puzzle. Like the first group, each row of the second group is parallel to the first surface begins at an edge that coincides with an edge orthogonal to the first surface. In this embodiment of the method, each row of the second group has one of each number without duplicate when the puzzle is solved. An embodiment of the inventive method requires the user to manipulate the puzzle until numerous SoDukos are present: vertical, horizontal, and regional. Thus, when in a solved condition, the vertical, horizontal, and regional are all solved simultaneously to define an integrated solution wherein the digits coincide.

The inventive method may also include the step of selecting a first group of three vertical columns, each beginning at an edge of the first surface and traversing the first surface. Each column will have no duplicate numbers when the puzzle is solved. Additionally, the inventive method may also include the step of selecting a second group of three columns that begin at an edge of the first surface and traverse the first surface. The columns will coincide on the first surface. Like the first group of columns, each column (or at least one column) will have no duplicate numbers when in the solved condition.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
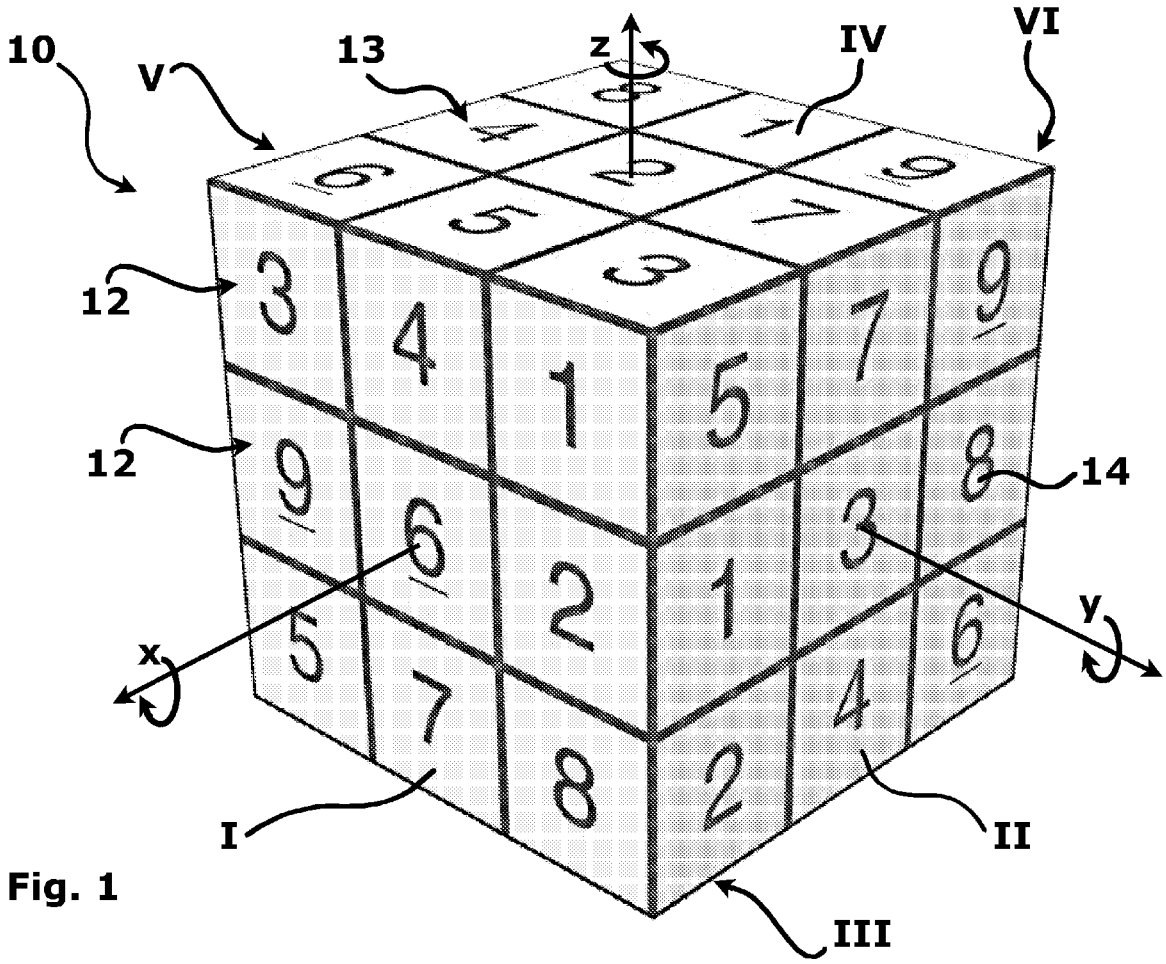
FIG. 1 shows a perspective view of the three-dimensional puzzle in a solved condition, according to the principles of the invention.

FIG. 1 shows a perspective view of the puzzle 10, according to the principles of the invention. The puzzle 10 includes a plurality of cubiform elements 12 linked together to form the shape of a cube. Each cubiform 12 has at least one face 13 that faces outward and forms part of a surface (I-VI) of the cube.

As shown in FIG. 1, axes of rotation x,y,z emanate from the center of the puzzle 10 and pass through the respective center-points of each respective surface I-VI of the cube. Integrally formed cams (not viewable in FIG. 1, but shown aft) link the individual cubiforms 12 together, but enable one to rotate a column ($C_1$-$C_6$) elative an adjacent column by imparting rotation about either axis y or axis x. The integrally forms cams also enable one to rotate a selected row ($R_1$-$R_6$) about an adjacent row by imparting rotation about axis z.

Still referring to FIG. 1, one should note that each visible surface I, II, and V of the puzzle 10 bears a single digit natural number 14, and each surface I, II, and V has only one of each single digit natural number. Of course, when the puzzle 10 is in a solved condition, each and every surface I-VI will have only one of each single-digit natural number.

Figure 2A:
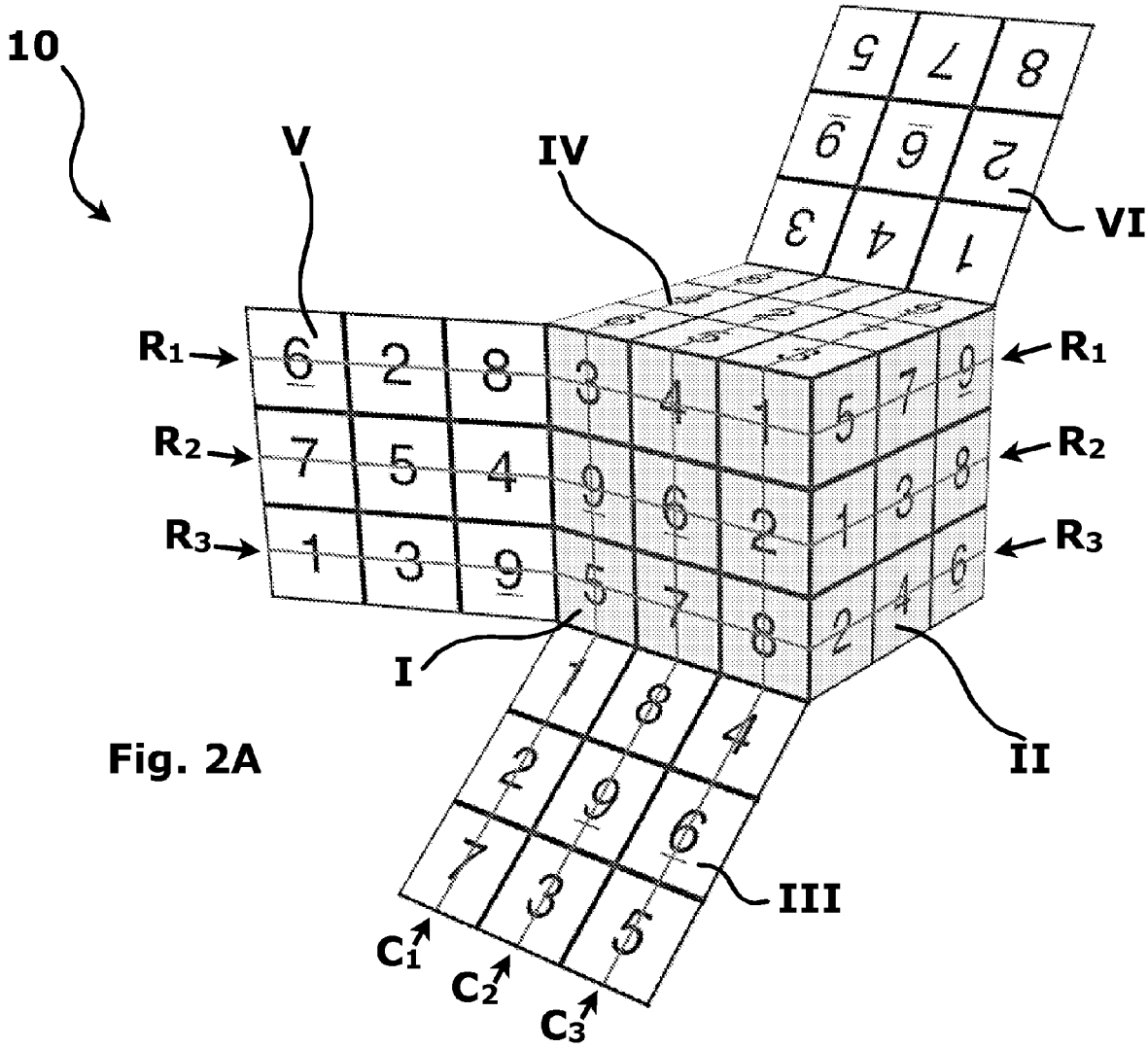
FIGS. 2A and 2B show perspective views of the three-dimensional puzzle, each shown in a partly-unfolded condition to enable viewing of all six sides.
Figure 2B:
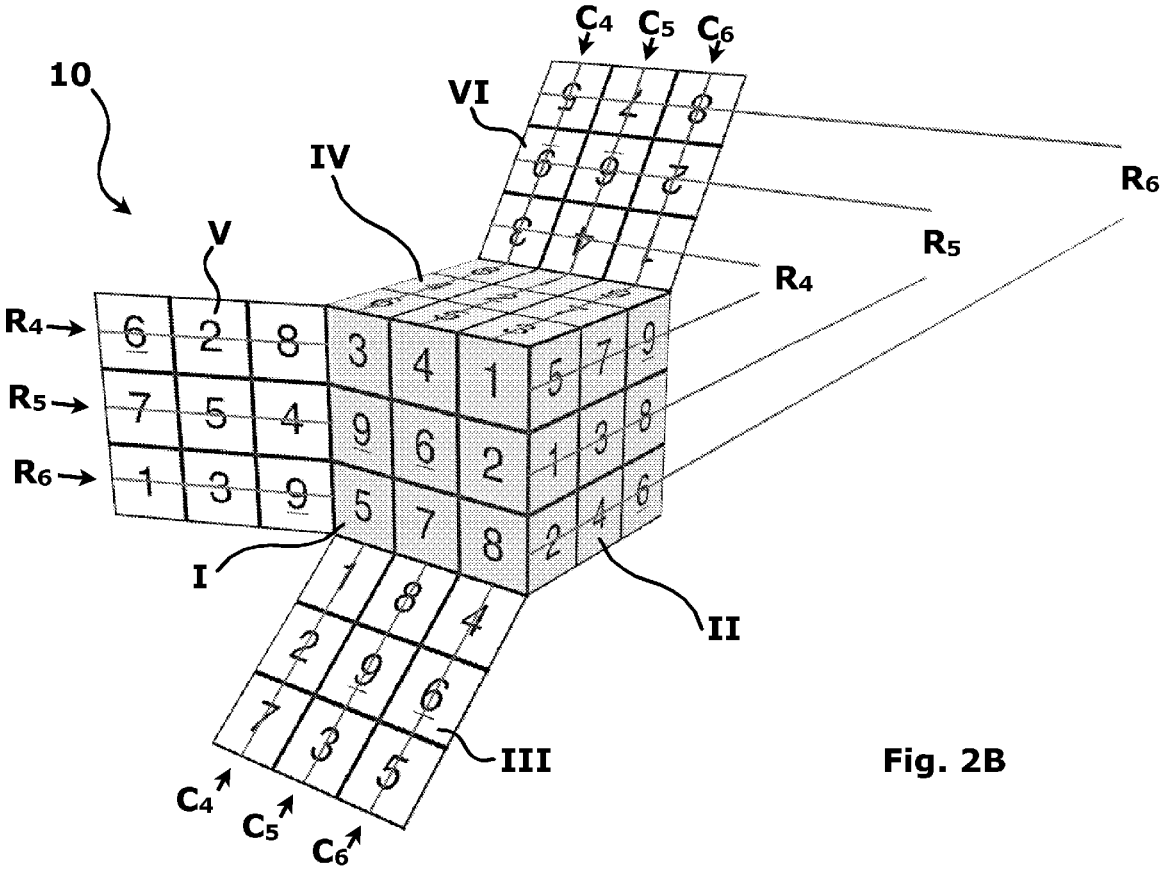

Still Referring to FIG. 1, as the puzzle 10 rests on surface VI, six columns $C_1$-$C_6$ all begin at an edge 16 of the bottom surface VI (not detailed in FIG. 1, viewable in FIGS. 2A, 2B, aft). Also viewable are horizontal rows $R_1$-$R_3$, When the puzzle 10 is in a solved condition, each of the columns $C_1$-$C_6$ will include one of each natural number, with no duplicates. As shown, nine consecutively adjacent faces 13 of cubiforms 12 form each column $C_1$-$C_6$.

Of course, there are many embodiments and possibilities to solutions for the puzzle 10. In one embodiment, one can attempt to solve only the faces I-VI of the puzzle; then one can further manipulate the puzzle about axes x,y,and z until one or more columns $C_1$-$C_6$ contains only one of each numeral with no duplicates, and each of the rows does the same.

FIG. 2A shows a unique perspective view of the puzzle 10 with the invisible surfaces III, IV, and VI "unfolded" so that one may view all of the numbers in a single view. Note that the Rows $R_1$-$R_3$ traverse surfaces V, I, and II, and Columns $C_1$-$C_3$ traverse surfaces III, I and IV. As shown, each of the surfaces shown I-VI bears only one of each number with no duplicates. In this view, the rows $R_1$-$R_3$ contain only one of each numeral and are therefore "solved." Additionally, Columns $C_1$-$C_3$ also contain no duplicates.

FIG. 2B shows the same unique perspective view as shown in FIG. 2A, but focuses upon rows and columns 4-6. Rows $R_4$-$R_6$ pass along surfaces II, VI, and V, and Columns $C_4$-$C_6$ pass along surfaces III, VI and IV. In this view, the Rows $R_4$-$R_6$ Columns $C_4$-$C_6$ each contain only one of each number without duplicate.

Figure 3:
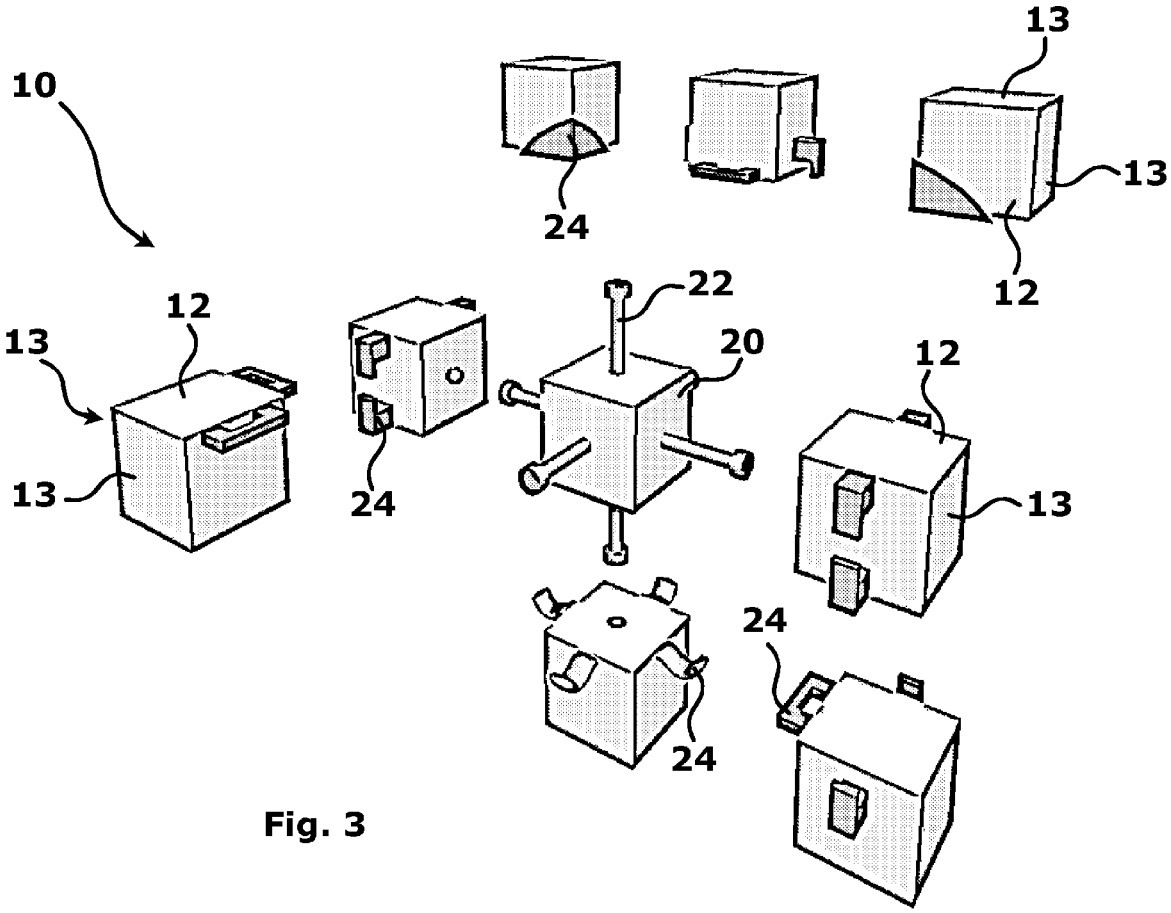
FIG. 3 is a detailed and exploded view of the three dimensional puzzle, detailing individual cubiform elements and respective integral cams.

FIG. 3 is an exploded view showing the puzzle 10 in a disassembled state. The puzzle 10 includes a center cubiform element 20 having post-cams 22 that engage within adjacent centric cubiform elements 12 that will expose only a single face 13 of a respective surface I-VI. Center-edge elements 12, of course, will expose two adjacent faces 13, and corner-oriented cubiform elements 12 will expose three faces, and will form corners of the cube-shaped puzzle 10.

As shown in FIG. 3, each respective cubiform element 12 will bear integrally-formed cams that face inward toward the center cubiform 20, and will engage an adjacent cubiform to enable relative rotation of a selected row or column of cubiforms 12 about axes of rotation that coincide with post-cams 22.

Figure 4A:
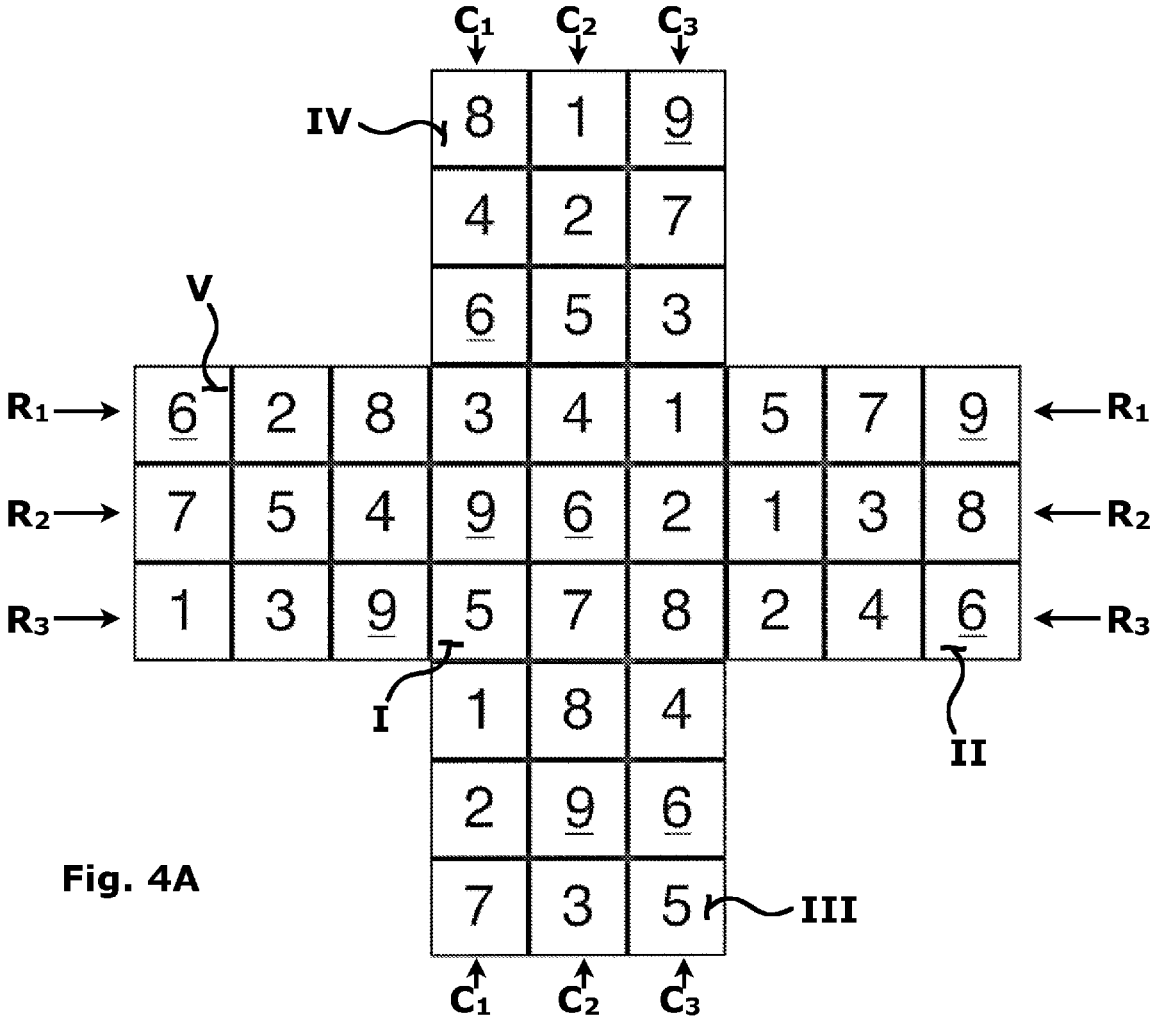
FIGS. 4A and 4B represent respective tree-diagrams detailing the row, column, and surface solutions of the puzzle.
Figure 4B:
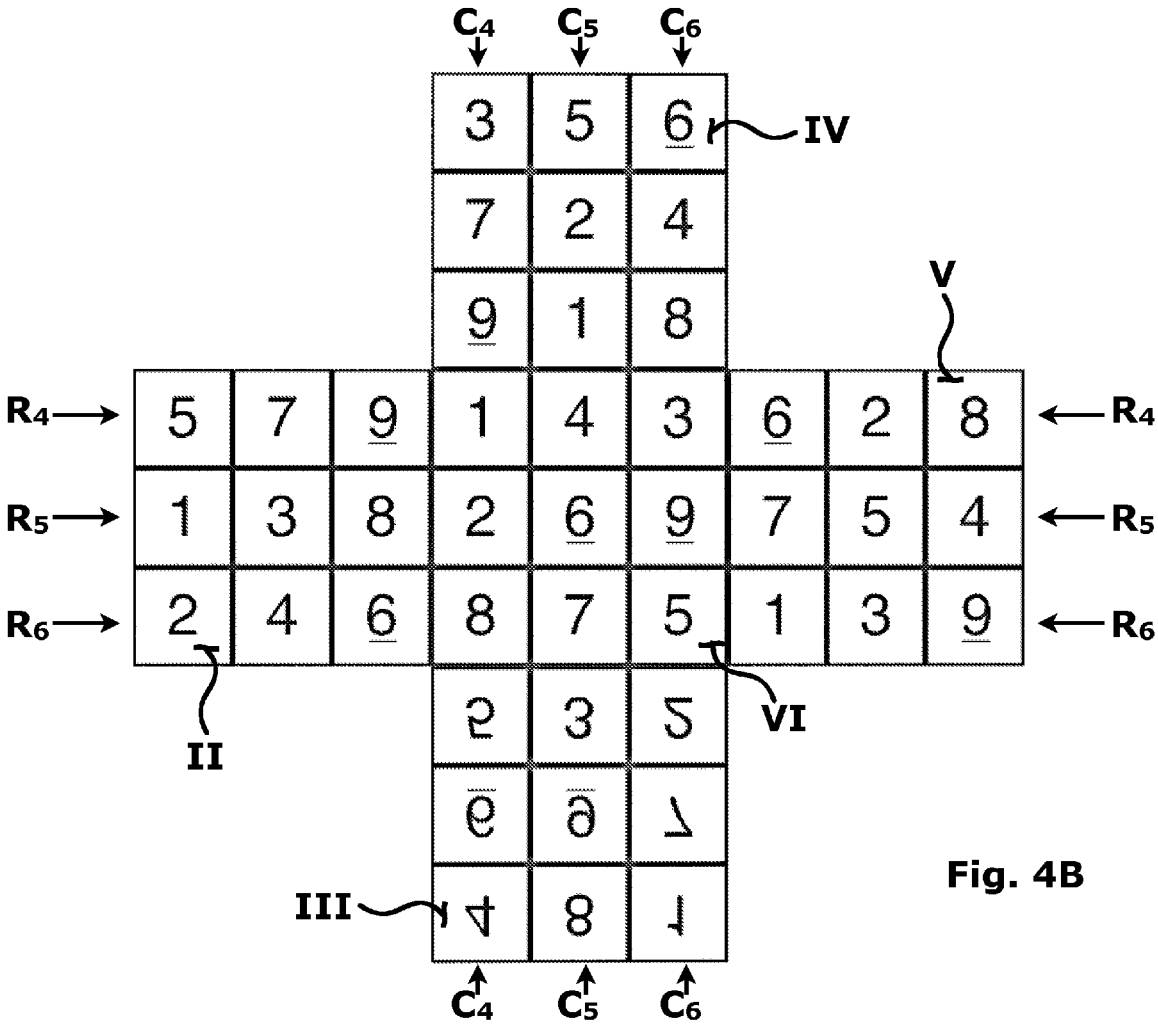

FIGS. 4A and 4B are respective tree diagrams showing the spatial relationship of the faces and surfaces of the puzzle, when the puzzle is in its perfectly-solved state. Note that each of these figures shows only five of the six sides of the cube; indeed, side VI cannot be viewed in these Figures. However, it is important to note that side VI will be the mirror-image of side I, such that sides I and VI bear identical numbers on faces that are directly across the cube from one another.

The FIGS. 4A and 4B are helpful to give a better understanding of the spatial relationship of the rows and columns that are depicted in FIGS. 2A and 2B, respectively.

It is important to note that the invention may include numerous levels of difficulty. For example, one could opt to solve only rows—or just a single row—by manipulating the puzzle until the selected row(s) contains nine consecutive elements with no duplicate numbers. Analogously, one could do the same for column(s) only, or surfaces only. A more difficult game, of course, is to combine two or more of these requirements (row, column, surface) into the required solution. A master, or most complete solution, will comprise eighteen (18) Sudokus total.

In yet another embodiment (not shown), the numbers themselves may bear distinct indicia, such as colored numerals or colored backgrounds for the numerals. The puzzle may also be solved by manipulating the rows and columns until at least one side bears like indicia.

Although the present invention has been described and illustrated in detail, it is to be clearly understood that the same is by way of illustration and example only, and is not to be taken by way of limitation. The spirit and scope of the present invention are to be limited only by claims that will precisely define the metes and bounds of the invention.

I claim:

1. A three-dimensional puzzle bearing a shape of a cube, the puzzle comprising:

cubiform elements of substantially uniform size, the cubiform elements joined together so that outer faces of the cubiform elements comprise respective surfaces of the cube;

mutually perpendicular axes intersecting at a centroid of the cube and passing orthogonally through a center point of each face of the cube;

integrally formed cam elements configured to retain horizontal rows of cubiform elements into engagement with one another, yet allow relative movement of one of a selected row with respect to its adjacent row, integrally formed cam elements configured to retain vertical columns of cubiform elements into engagement with one another, yet allow relative movement of one selected column with respect to an adjacent column;

wherein, the integrally formed cam elements allow relative rotation of a selected one of a row or column, the relative rotation being about one of the axes at one selected time;

an indicia on each outer face the indicia consisting of single digit natural numbers;

a first surface that is horizontal and facing downward;

a first group of three rows, each row having nine consecutive elements that traverse three contiguous surfaces of the puzzle; and, an orientation parallel to the first surface, and and each row also having a beginning coinciding with a first edge orthogonal the first surface, and, one of each indicia without duplicate when the puzzle is in a solved condition wherein, when the puzzle in the solved condition, at least one surface bears each indicia with no duplicate indicia.

2. The three-dimensional puzzle as in claim 1, wherein, more than one of the surfaces bears each of the indicia with no duplicates when in the solved condition.

3. The three-dimensional puzzle as in claim 1, wherein each and every surface consists of one of each indicia when in the solved condition.

4. The three dimensional puzzle as in claim 1, further comprising:

a second group of three rows, each row having nine consecutive elements that traverse three contiguous faces of the puzzle, and an orientation parallel the first surface, and a beginning that coincides with a second edge that is orthogonal to the first surface, and one of each indicia without duplicate, when the puzzle is in the solved condition.

5. The three dimensional puzzle as in claim 1, further comprising a first surface that is horizontal and facing downward;

a first group of three selected columns, each column beginning at an edge of the first surface and traversing the first surface, wherein each column consists of no duplicate indicia when the puzzle is in the solved condition.

6. The three dimensional puzzle as in claim 5, further comprising a second group of three selected columns, each column beginning at an edge of the first surface and traversing the first surface, wherein each of the second group of columns consists of no duplicate indicia when the puzzle is in the solved condition.

7. The three dimensional puzzle as in claim 6, wherein the columns of the first group and columns of the second group coincide on the first surface.

8. A method of integrating spatial logic with a three-dimensional puzzle, the method comprising the steps of:

providing cubiform elements of substantially uniform size, the cubiform elements joined together so that outer faces of the cubiform elements comprise respective surfaces of a cube;

providing mutually perpendicular axes of rotation that intersect at a centroid of the cube and passing orthogonally through a center point of each surface of the cube;

integrally forming cam elements configured to retain horizontal rows of cubiform elements into engagement with one another, yet allow relative movement of one of a selected row with respect to its adjacent row, integrally forming cam elements configured to retain vertical columns of cubiform elements into engagement with one another, yet allow relative movement of one selected column with respect to an adjacent column;

wherein, the integrally formed cam elements allow relative rotation of a selected one of a row or column, the relative rotation being about one of the axes at one selected time;

providing a plurality of unique indicia, the indicia consisting of single digit natural numbers and placing a single indicium on each outer face of the puzzle;

orienting the puzzle so that a first surface is horizontal and facing downward;

facing a first surface of the puzzle downward;

selecting a first group of three rows, wherein each row has nine consecutive elements that traverse three contiguous surfaces of the puzzle and each row has an orientation parallel to the first surface;

solving the puzzle by rotational manipulation of the rows and columns of the puzzle until at least one surface bears each of the indicia without duplicates; and each row begins at a first edge orthogonal the first surface and has one of each indicia without duplicate.

9. The method as in claim 8, wherein the step of solving the puzzle includes rotational manipulation of the rows and columns until more than one surfaces bears each of the numbers with no duplicates.

10. The method as in claim 8, wherein each and every surface consists of each natural number when the puzzle is in a solved condition.

11. The method as in claim 8 further comprising the steps of selecting a second group of three rows such that each row has nine consecutive elements that traverse three contiguous faces of the puzzle, and an orientation parallel the first surface, and a beginning that coincides with a second edge that is orthogonal to the first surface; wherein, each row of the second group has one of each indicia without duplicate when the puzzle is in the solved condition.

12. The method as in claim 8, further comprising orienting a first surface to be horizontal and facing downward;

selecting a first group of three columns, each column beginning at an edge of the first surface and traversing the first surface, wherein each column consists of no duplicate indicia when the puzzle is solved.

13. The method in claim 12 further comprising the step of selecting a second group of three columns, each column beginning at an edge of the first surface and traversing the first surface; wherein, each of the second group of columns consists of no duplicate indicia when the puzzle is solved.

14. The method as in claim 13, further comprising the step of selecting the columns of the first group to coincide with columns of the second group on the first surface.

15. A three-dimensional puzzle bearing a shape of a cube, the puzzle comprising:

cubiform elements of substantially uniform size, the cubiform elements joined together so that outer faces of the cubiform elements comprise respective surfaces of the cube;

mutually perpendicular axes intersecting at a centroid of the cube and passing orthogonally through a center point of each face of the cube;

integrally formed cam elements configured to retain horizontal rows of cubiform elements into engagement with one another, yet allow relative movement of one of a selected row with respect to its adjacent row, integrally formed cam elements configured to retain vertical columns of cubiform elements into engagement with one another, yet allow relative movement of one selected column with respect to an adjacent column;

wherein, the integrally formed cam elements allow relative rotation of a selected one of a row or column, the relative rotation being about one of the axes at one selected time;

one single-digit natural number on each outer face;

a first surface that is horizontal and facing downward;

a first group of three rows, each row having nine consecutive elements that traverse three contiguous surfaces of the puzzle and an orientation parallel to the first surface, a beginning coinciding with an edge orthogonal the first surface a second group of three rows, each row having nine consecutive elements that traverse three contiguous faces of the puzzle, and an orientation parallel the first surface, and a beginning that coincides with an edge orthogonal to the first surface, and one of each number without duplicate;

a first group of three selected columns, each column of the first group beginning at an edge of the first surface and traversing the first surface;

a second group of three selected columns, each column of the second group beginning at an edge of the first surface and traversing the first surface; wherein, each column of the first group of columns consists of each number without duplicate;

each column of the second group of columns consists of each number without duplicate;

each row of the first group of rows consists of each number without duplicate;

each row of the second group of rows consists of each number without duplicate;

and each surface bears only one of each natural number without duplicate when the puzzle is solved.

* * * * *